United States Patent [19]

Iacobucci

[11] Patent Number: 4,902,238

[45] Date of Patent: Feb. 20, 1990

[54] ELECTRICAL CONNECTOR RECEPTACLE COVER

[75] Inventor: Cesidio R. Iacobucci, La Crescenta, Calif.

[73] Assignee: Glenair, Inc., Glendale, Calif.

[21] Appl. No.: 296,526

[22] Filed: Jan. 12, 1989

[51] Int. Cl.[4] ..... H01R 13/44; H01R 13/62

[52] U.S. Cl. ..... 439/135; 439/139; 439/312

[58] Field of Search ..... 439/135–147, 439/312, 313, 315, 320, 349, 367

[56] References Cited

U.S. PATENT DOCUMENTS

| | | | |
|---|---|---|---|
| 4,140,358 | 2/1979 | Marechal | 439/139 |
| 4,365,858 | 12/1982 | Karol | 439/135 |
| 4,487,470 | 12/1984 | Knapp et al. | 439/312 |

OTHER PUBLICATIONS

Industrial Connectors and Interconnect Systems for Severe Environments, G&H Technology, Inc., 1983.

*Primary Examiner*—P. Austin Bradley

*Attorney, Agent, or Firm*—Poms, Smith, Lande & Rose

[57] ABSTRACT

A protective cover for a multiple pin type electrical connector receptacle having an insert shell provided with a plurality of locking keys spaced about the circumference of the shell to receive mating, locking lands on the cover, is disclosed wherein the cover is provided with an additional antirotational locking means between the cover and shell for preventing unintentional release rotation of the cover relative the shell when they are in an assembled relation. The exemplary embodiment of antirotational locking means includes the provision of a spring detent means mounted within the cover wherein a generally V-shaped detent is spring mounted as part of an integral, one piece contoured spring metal plate to cooperate with an orienting key on the shell to prevent unintentional release of the cover from the shell due to the resiliency of the detent engaging over the orienting key when the cover is rotated into its fully assembled position relative the shell.

22 Claims, 2 Drawing Sheets

Fig. 1.
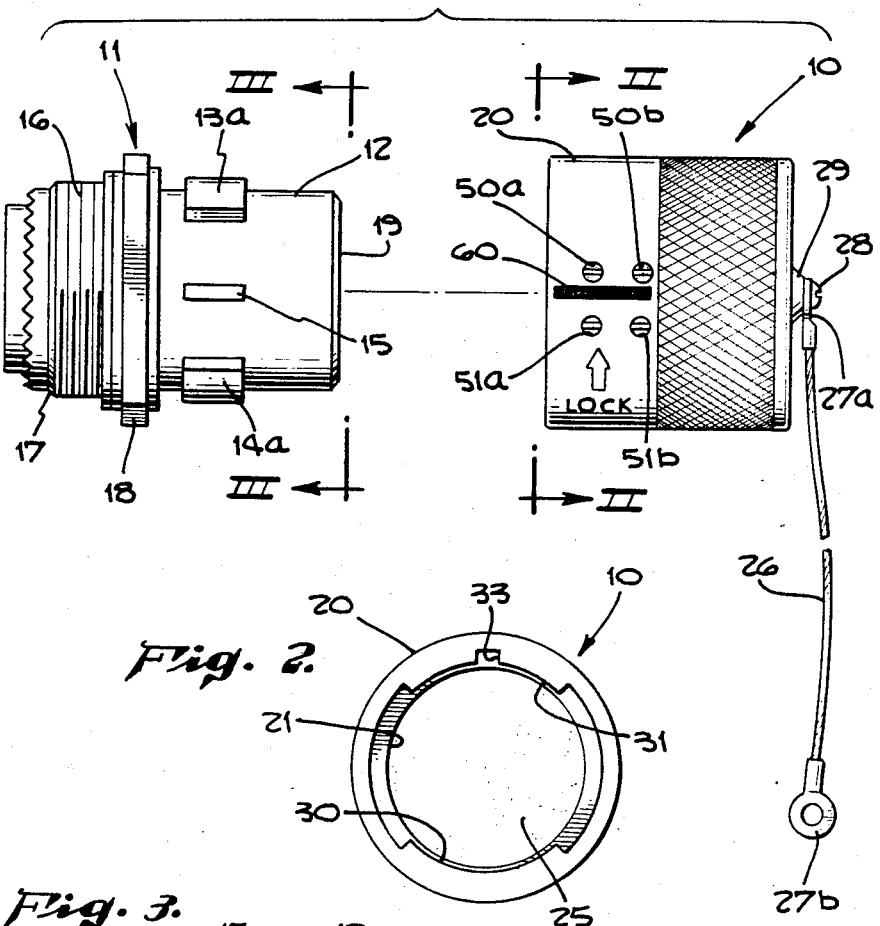
Fig. 2.
Fig. 3.
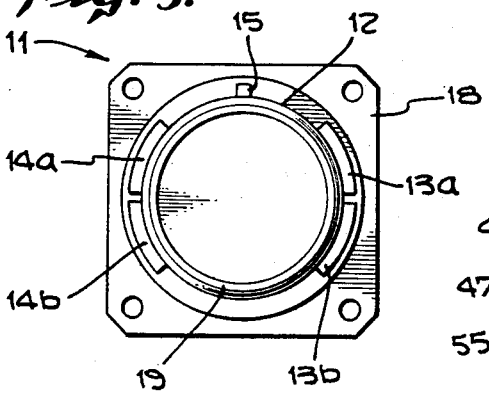
Fig. 8.
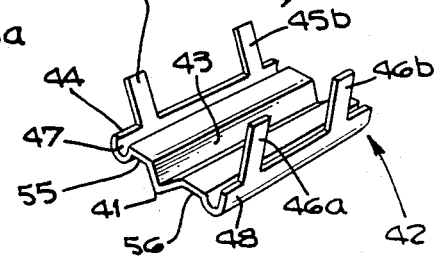

Fig. 4.
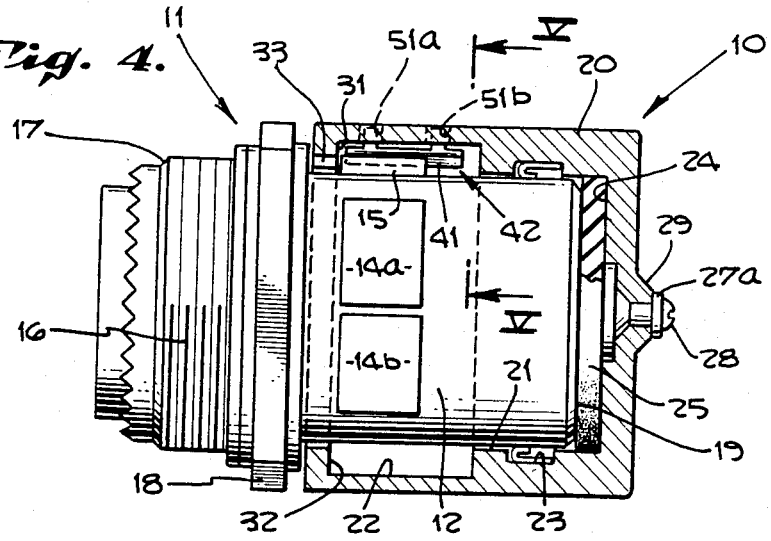
Fig. 5.
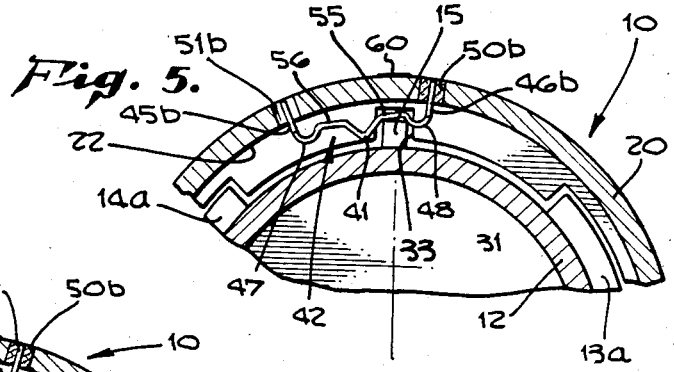
Fig. 6.
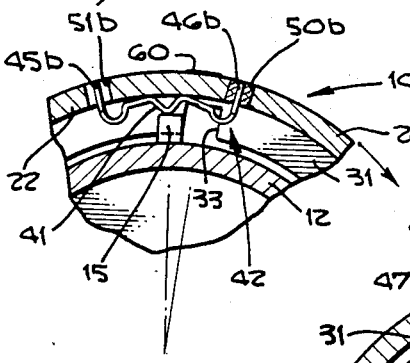
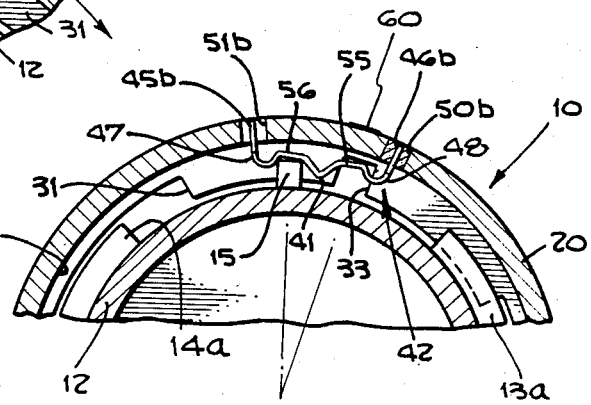
Fig. 7.

ELECTRICAL CONNECTOR RECEPTACLE COVER

BACKGROUND OF THE INVENTION:

The present invention relates in general to multiple pin type electrical connectors including a receptacle and plug assembly of known configuration and more specifically to a protective cover for covering and protecting the pins of the receptacle when it is not engaged by an associated plug.

It is well known in the electrical connector art to provide multiple pin type electrical connector receptacles with protective covers for protecting the receptacle when it is not engaged by a mating plug. Such covers heretofore have comprised the provision of a cap like body having locking lands associated with an inner bore thereof to ride behind mating locking keys already provided upon the receptacle shell for engaging and locking with the associated plug. It has been common in such prior cover constructions to rely upon the friction fit provided by the riding of the cover lands behind the shell keys in association with the provision of a resilient gasket within the cover bore which provided a reasonably effective frictional fit for the cover to shell assembly. However, it has been observed that under certain circumstances, as when the receptacle and cover are subjected to continuous vibrational conditions, and/or when the gasket loses some of its resiliency or is deformed through repeated use, the protective covers of the prior art have, on occasion, failed to remain in place covering the receptacle. It is quite important that the plurality of pins within the receptacle shell be protected from external factors when not engaged with a mating plug. The need for a cover which would not be susceptible to release through inadvertent contact, vibrational conditions, or the like, has thus become recognized yet unsolved heretofore.

It is therefore the primary object of the present invention to provide a protective cover for a multiple pin type electrical connector receptacle which will assure its continued protective function once assembled to the receptacle until it is intentionally manually released from its engagement with the receptacle. It is a further object of the present invention to provide such a protective cover which is easily manufactured in a reasonably inexpensive manner, is reliable in use, and is easily manipulated as part of the normal cover to receptacle mounting procedures to effect its secure retention thereto.

SUMMARY OF THE INVENTION

Generally stated, the within invention in a protective cover for a multiple pin type electrical connector receptacle, having an insert shell and one or more locking keys on the shell, has a cap like body having an insert shell receiving bore with one or more locking lands within the bore for engaging with the locking keys of the shell to prevent relative axial movement of the shell and body when the same are fitted to one another and includes specifically the provision in such cover of an antirotational locking means in addition to said lands and keys for providing a manually overrideable locking engagement between the cover and shell whereby unintentional release rotation of the cover from the shell is prevented when the two are placed in an interlocking relation.

More specifically, the present invention in an improved protective cover construction includes the provision of a detent means within the cover which functions as an antirotational locking means by providing a spring bias detent within the cover which resiliently snaps over one of the locking keys on the receptacle when the cover is rotated to place the cover locking lands behind the receptacle locking keys. More specifically, such spring detent, in a preferred exemplary embodiment, is provided in the form of a one-piece contoured spring having a generally V-shaped depending detent portion, key receiving ways on either side of the detent portion and laterally outwardly spaced mounting legs upstanding in outwardly biased manner from resilient end flanges, all of the same being integral with one another, whereby the detent may be easily assembled to mounting apertures provided within the cover as a one-piece press fit assembly.

A more complete understanding of the present invention as well as a realization of additional objects and advantages thereof, will be afforded to those skilled in the art from a consideration of the following detailed description of a preferred exemplary embodiment thereof. Reference will be made therein to the appended sheets of drawings which will be first briefly described.

BRIEF DESCRIPTION OF THE DRAWINGS:

FIG. 1 is an exploded view of a protective cover and multiple pin type electrical connector receptacle assembly in accordance with the present invention;

FIG. 2 is an end view of the exemplary embodiment of protective cover of FIG. 1. Taken therein along the plane II—II;

FIG. 3 is an end view of the exemplary embodiment of multiple pin type electrical connector receptacle of FIG. 1 taken therein along the plane III—III;

FIG. 4 is a side elevational view of the exemplary assembly of cover and receptacle of FIG. 1 showing a preferred exemplary embodiment of cover, in accordance with the present invention, in a vertical cross sectional view thereof;

FIG. 5 is a detailed section view of a portion of the assembly of FIG. 4 taken therein along the plane V—V showing a receptacle associated key received in a first way of the exemplary detent means mounted within the cover;

FIG. 6 is a view as in FIG. 5 showing rotation of the cover relative the receptacle with the exemplary detent means engaging over the receptacle key;

FIG. 7 is a view as in FIGS. 5 and 6 showing the cover fully rotated into a cover to receptacle locking position wherein the receptacle associated key is retained by the detent in a second way of the exemplary embodiment of the detent means; and FIG. 8 is a perspective view of the exemplary embodiment of detent means employed in the cover and receptacle assembly of FIGS. 1 through 7.

DETAILED DESCRIPTION OF A PREFERRED EXEMPLARY EMBODIMENT

A preferred exemplary embodiment of the protective cover, in accordance with the present invention, for a multiple pin type electrical connector receptacle is illustrated generally at 10 in FIG. 1 in association with an exemplary embodiment of multiple pin type electrical connector receptacle, indicated generally at 11, having an insert shell 12. The exemplary receptacle, indicated generally at 11, may be made in accordance with military specifications MIL-C-38999 Series IV, and, as is typical of such receptacles, is provided with a plurality of locking keys on the shell in known manner. As seen in FIGS. 1 and 3, the exemplary insert shell 12 of the receptacle is provided with two pairs of locking keys 13*a*, 13*b*, and 14*a*, 14*b*, with on generally diametrically opposed sides of the shell (as seen in FIG. 3). A more narrow key 15 of the locking keys, as seen in FIGS. 1 and 3, serves as an orienting key for orienting the alignment of the locking keys of the receptacle to a mating electrical plug as is known in the art. The illustrated receptacle, indicated generally at 11,is of a wall mounting configuration having a V thread 16 on a rear barrel portion 17 to be connected into an electrical multi-wired conduit associated with the multiple pins of the receptacle. A mounting flange 18 is provided in known manner for mounting the receptacle at a wall installation. The electrical connector receptacle, indicated generally at 11, is a standard component known in the art heretofore and is not, per se, a part of the present invention.

As is particularly contemplated within the present invention, an improved protective cover, indicated generally at 10, is provided with an antirotational locking means operable between the cover and shell !2 for preventing unintentional release of the cover after it is manually assembled and rotated into a locking position relative the shell, as will now be explained in detail. The exemplary cover, indicated generally at 10, includes a cap like body 20 having an insert shell receiving bore 21 which, as best seen in the vertical section view of FIG. 4, is further provided with a first, frontal recess 22 and a second, rearward internal recess 23. Bore 21 is closed at its inner end by a rear wall 24 which is integral of body 20. As is otherwise known in the art, a resilient gasket 25 may be provided within bore 21 at the inner wall 24 to abut against the open end 19 of shell 12 when the cover is assembled thereto as seen in FIG. 4. As is also known in the art heretofore, the cover may have a retention wire 26 having end eyelets 27*a* and 27*b* whereby the cover can be retained adjacent a location of use in known manner. As seen in FIGS. 1 and 4, the eyelet 27*a* is secured by fastener 28 to a boss 29 formed integrally of the cover body 20 in a conventional manner.

Referring now to FIGS. 2 and 4, the exemplary embodiment of protective cover, indicated generally at 10, is provided with one or more locking lands within the cover bore 21 for engaging with one or more of the locking keys of the insert shell to prevent relative axial movement of the shell and cover when the cover body is fitted over and rotated into a cover-to-shell locking position. In the exemplary embodiment, such locking lands include the lands 30 and 31, as best seen in FIG. 2; the land 31 having a keyway 33. The configuration of lands 30 and 31, as well as keyway 33, in the exemplary embodiment is provided so as to mate with the locking keys 13*a*, 13*b* and 14*a*, 14*b*, when the body 20 is slip fit in an axial direction onto the insert shell 12 with the keyway 33 receiving key 15, as seen in FIG. 4. When the orienting key !5 passes behind land 31, the cover body 20 may be rotated relative the shell 12 to place the body lands 30 and 31 behind the locking keys to thereby prevent axial withdrawal of the cover from the shell. Heretofore, the prior art covers relied upon the friction fit of gasket 25 against the end 19 of shell 12 when the cover lands and shell keys were in such locking relation to prevent unintentional antilocking rotation of the cover. However, as discussed hereinbefore, such prior art covers have failed to perform their protective function in various environmental conditions where unintentional rotative motion has been experienced by the covers due to vibration or other factors and have failed to perform their protective function.

As is particularly contemplated within the present invention, antirotational locking means are provided between the cover and shell for preventing such unintentional release rotation of the cover relative the shell when they are placed in the aforementioned locking position, i.e., the cover locking lands 30 and 31 are turned behind the shell locking keys 13*a*, 13*b*, and 14*a*, 14*b*, as seen in FIG. 7. In the exemplary embodiment, such antirotational locking means comprises a detent 41 mounted within bore recess 22 and aligned by associated mounting means therein to interfere with the orienting key 15, and thus prevent unintentional unlocking rotation of the cover relative the shell, after the cover has been slip fit onto and rotated relative the shell in a predetermined manner as will now be explained.

In the exemplary embodiment, the detent 41 is provided as a part of a detent means, indicated generally at 42 in FIG. 8, which is adapted in accordance with the present invention, to be provided as a one-piece, contoured, spring metal plate bent to provide a generally V-shaped depending central detent portion which can be easily assembled into bore recess 22. Mounting legs 45*a*, 45*b*, and 46*a*, 46*b*, are provided in spaced pairs, as seen in FIG. 8, integral of plate 44, and in upstanding relatively outwardly biased relation by the resiliency of the legs and upturned side flanges 47 and 48. These mounting legs are sized so as to require a press fit into the mounting apertures 50*a*, 50*b*, and 51*a*, 51*b*, respectively, provided in the cover body as seen in FIGS. 1 and 4 through 7. In addition, to ensure permanent assembly of the detent means to the cover, a body of epoxy material may be filled in to the apertures 50*a*, 50*b*, as illustrated.

As is also best seen in FIG. 8, the exemplary detent means, indicated generally at 42 in FIG. 8, is provided with a first way 55, formed integrally of plate 44 on a first side of detent 41, and a second way 56, formed integrally of plate 44 on a second side of detent 41, as seen in FIG. 8. The ways 55, 56, are of general channel configuration and lie between the central, generally V-shaped depending portion 43 and the outwardly spaced end flanges 47 and 48, respectively. The first way 55, as seen in FIG. 5, is adapted to function as a key receiving way when the shell orienting key 15 is slip fit through cover orienting keyway 33, the key 15 sliding under way 55 in a slip fit relation. An orienting indicia 60 is provided in the form of a orienting line, which may be painted or otherwise applied to the exterior of body 20, and which lies directly above the first key receiving way 55 as best seen in FIG. 5. When the cover has been axially slip fit onto the shell so as to place the cover lands 30, 31 behind shell keys 13*a*, 13*b* and 14*a*, 14*b*, rotation of the cover in a clockwise direction in FIGS. 5 through 7 causes the spring detent 41 to deflect over keyway 15 as seen in FIG. 6 until the key 15 is received in the second key receiving way 56 as seen in FIG. 7. Second key receiving way 56 thus functions as a locking way in association with detent 41 which then impedes antirotation of the cover in an unlocking manner of rotation. The end flange 47 provides an abutment, as seen in FIG. 7, at the outer edge of way 56 which prevents overturning of the cover relative to the shell which might otherwise cause a release of the detent means from its interfering relationship with the orienting key 15.

The detent 41 thus prevents an unintentional antirotation of the cover relative the shell until the cover is intentionally manually rotated to a release position, as seen in FIG. 5, whereby the cover may be simply slipped axially off of the shell 12.

Having thus described a preferred exemplary embodiment of a protective cover for a multiple pin type electrical connector receptacle in accordance with the present invention, it should be kept in mind by those skilled in the art, that various modifications, adaptations, and alternative embodiments thereof may be made within the scope of the within invention which is defined by the following claims.

What is claimed:

1. A protective cover for a multiple pin type electrical connector receptacle having an insert shell and one or more locking keys on said shell, said cover comprising:

a cap like body having an insert shell receiving bore and one or more locking lands within said bore for engaging with said one or more locking keys to prevent relative axial movement of said shell and body when said body is fitted over and rotated into a cover to shell locking position, wherein said antirotational locking means comprises:

a detent means provided upon one of said body and shell for releasably holding said body and shell against relative rotation, said detent means being overrideable by intentional manual release rotation of said cap like body relative said shell, wherein said detent means comprises:

a spring mounted to said body within said body bore having a detent portion of said spring extending into said bore relative said body to resiliently ride over one of said locking keys when said cap like body is fitted over and rotated relative said shell to said cover to shell locking position.

2. The cover as in claim 1 wherein:

one of said locking keys is an orienting key for orienting a mating connector plug, or the like, to be assembled to said shell and said cap like body has an orienting keyway opening to said bore whereby said body and shell are oriented in a predetermined manner relative each other by said orienting key entering said orienting keyway when said body is fitted over said shell; and said detent means spring is provided with an orienting key receiving recess on a first side of said detent portion and aligned to said orienting keyway to receive said orienting key in said orienting recess of said spring when said body is fitted over said shell.

3. The cover of claim 2 wherein said detent means spring is provided with an orienting key retaining recess or a second side of said detent portion whereby rotation of said cap like body relative said shell after said orienting key is received in said orienting recess of said spring causes said detent portion to spring over said orienting key which is then releasably retained in said retaining recess.

4. The cover of claim 3 wherein said detent means further comprises said spring being provided in the form of a one piece contoured spring metal plate bent to provide said detent portion, orienting recess and retention recess integrally of one another.

5. The cover of claim 4 wherein said detent means spring further comprises a plurality of mounting keys formed integrally of said plate which are retained to raise cap like body at least in part by the resiliency of said plate, said legs being received in spaced apertures provided on the interior of said bore.

6. The cover of claim 5 wherein said mounting legs are press fit into said apertures.

7. The cover of claim 6 wherein one or more of said apertures are filled with epoxy after reception of a leg of said legs to facilitate the retention of said spring to said body.

8. The protective cover for a multiple pin type electrical connector receptacle having an insert shell and one or more locking keys on said shell, said cover comprising:

a cap like body having an insert shell receiving bore and one or more locking lands within said bore for engaging with said one or more locking key when said cap like body is fitted over and rotated in a locking rotation direction relative said shell; and a manually overrideable antirotation locking means on said body for impeding a release rotation of said body relative said shell when said lands and keys are fully engaged until said cap is intentionally manually rotated in a release rotation direction, wherein said locking means comprises:

a spring mounted detent provided within said bore of said body whereby said detent is deflected over one of said keys during said locking direction rotation to thereby impede subsequent reverse rotation of said body.

9. The cover of claim 8 wherein said spring mounted detent comprises:

a contoured spring having an integral, generally depending central detent portion, provided to deflect over said one of said keys.

10. The cover of claim 9 wherein said spring body comprises:

side flanges, each having a pair of upstanding mounting legs adapted to be received in mounting apertures provided within said body bore.

11. The cover of claim 10 wherein:

said mounting legs are sized to be press fit within said mounting apertures.

12. The cover of claim 11 wherein:

said pair of legs on said side flanges are laterally spaced relative each other so as to require bending of said spring body upon assembly of said pair of legs to said apertures to enhance said fit of said legs in said apertures.

13. The cover of claim 8 wherein one of said insert shell keys is an orienting key, said body has an orienting keyway to receive said key, and said spring mounted detent comprises:

a spring secured within the bore of said cap like body and having a detent portion and orienting key receiving ways on either side of said detent portion whereby said orienting key may be received in one way of said ways on insertion of said insert shell within said cover bore and subsequently received within the other way of said ways upon subsequent manual rotation of said cover relative said shell which moves said detent portion over said orienting key, a subsequent antirotation of said cover being thereafter impeded by the presence of said detent portion adjacent said orienting key until said cover is intentionally manually rotated to bring said orienting key back into said one way.

14. The cover of claim 13 wherein:

an orienting indicia is provided on the exterior of said cap like body in direct overlying relation to said one way of said spring whereby said one way may be physically oriented to said orienting key by visually orienting said indicia to said orienting key on fitting of said cap like body over said shell.

15. The cover of claim 13 wherein said means are provided for mounting said spring body within said cover to align said one way with said orienting keyway.

16. The cover of claim 15 wherein said means for mounting comprises mounting leg portions of said spring which are provided so as to require a press fit into mating apertures provided within said bore.

17. A protective cover for a multiple pin type electrical connector receptacle having an insert shell and a plurality of keys spaced about the circumference of the shell to receive a mating connector plug shell having mating locking lands for connecting the two shells together, one of said keys being a relatively narrow shell orienting key, said cover comprising:

a cylindrical body having an insert shell receiving bore and a plurality of locking lands for engaging with said keys to hold said body and shell together, one of said locking lands having a keyway therethrough sized to receive said orienting key on said shell is received fully into said bore; and a cover to insert shell antirotation means on said body and in addition to said locking lands for engaging said orienting key and impeding rotation of said cover relative to said insert shell when said cover and shell are assembled with said locking lands fully engaged with said keys.

18. The protective cover of claim 17 wherein said antirotation means comprises a spring mounted detent on said body for resiliently deflecting over said orienting key on said cover body is rotated to bring said locking lands into full engagement with said keys to thereafter impede a reverse rotation of said cover relative said insert shell by virtue of said detent abutting said orienting key.

19. The protective cover of claim 18 wherein said antirotation means comprises:

a contoured spring body having a generally V-shaped depending central detent portion providing said detent and an orienting key receiving way on either side of said detent portion.

20. The protective cover of claim 19 wherein said spring body further comprises:

a pair of side edge flanges and a pair of upstanding mounting legs on each of said flanges; and said cover body has two spaced pairs of apertures in a sidewall thereof to receive said legs.

21. The protective cover of claim 18 wherein said spring mounted detent further comprises:

a contoured spring plate having an orienting key receiving groove and an orienting key locking groove laterally spaced relative each other and lying on opposite sides of said detent whereby said orienting key is slip fit into said receiving groove on axial movement of said cover onto said insert shell and, on rotation of said cover in a direction of rotation causing said detent to ride over said orienting key to place said orienting key in said locking groove, said cover being held by said orienting key and locking groove against further unintended rotation.

22. The protective cover of claim 21 wherein:

said locking groove is provided with a stop shoulder on an outboard side thereof spaced away from said detent whereby manual rotation of said cover in said direction of rotation beyond a position wherein said orienting key is in said locking groove is prevented.

* * * * *